US005824628A

United States Patent [19]

Coates et al.

[11] Patent Number: 5,824,628

[45] Date of Patent: Oct. 20, 1998

[54] LUBRICATING COMPOSITIONS

[75] Inventors: David Coates, Cholsey; Andrew Gelder, Wallingford, both of United Kingdom

[73] Assignee: Castrol Limited, Swindon, United Kingdom

[21] Appl. No.: 945,887

[22] PCT Filed: May 16, 1996

[86] PCT No.: PCT/GB96/01173

§ 371 Date: Jan. 23, 1998

§ 102(e) Date: Jan. 23, 1998

[87] PCT Pub. No.: WO96/36682

PCT Pub. Date: Nov. 21, 1996

[30] Foreign Application Priority Data

May 18, 1995 [GB] United Kingdom ..... 9510071

[51] Int. Cl.[6] ..... C10M 137/04; C10M 137/12

[52] U.S. Cl. ..... 508/433

[58] Field of Search ..... 508/433

[56] References Cited

U.S. PATENT DOCUMENTS

| | | | |
|---|---|---|---|
| 2,080,299 | 5/1937 | Benning et al. | 508/433 |
| 2,174,019 | 9/1939 | Sullivan | 508/433 |
| 3,321,401 | 5/1967 | Ford et al. | 252/46.7 |
| 4,158,633 | 6/1979 | Papay | 508/433 |
| 4,356,097 | 10/1982 | Papay | 508/433 |
| 4,612,128 | 9/1986 | Uematsu et al. | 252/32.5 |
| 4,803,000 | 2/1989 | Uematsu et al. | 252/32.5 |
| 5,245,070 | 9/1993 | Nishikawa et al. | 508/433 |
| 5,334,320 | 8/1994 | Tomizawa et al. | 252/46.6 |

FOREIGN PATENT DOCUMENTS

| | | |
|---|---|---|
| 0 510 633 | 10/1992 | European Pat. Off. . |
| 1 147 508 | 4/1969 | United Kingdom . |

OTHER PUBLICATIONS

Patent Abstracts of Japan, vol. 15, No. 31 (C–0798), 24 Jan. 1991 & JP,A,02 269197 (Idemitsu Kosan Co. Ltd.), 2 Nov. 1990.

Derwent Publications Ltd., London, GB AN 93–400548, XP002007960 & JP.A.05 302 093 (Tonen Corp.), 16 Nov. 1993.

*Primary Examiner*—Jerry D. Johnson

*Attorney, Agent, or Firm*—Bacon & Thomas

[57] ABSTRACT

A lubricating composition comprising: (a) a base oil; (b) an acid ester of phosphoric acid of formula (I), where $R_1$ is a monovalent organic group containing from 3 to 30 carbon atoms and $R_2$ is hydrogen or a monovalent organic group containing from 3 to 30 carbon atoms and (c) a phosphonate ester of formula (II), where $R_3$ and $R_4$ are independently monovalent organic groups containing from 1 to 10 carbon atoms and $R_5$ is a monovalent organic group containing from 4 to 30, preferably 10 to 24 carbon atoms, the amounts of (b) and (c) being sufficient to improve the frictional properties is disclosed.

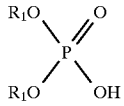

(I)

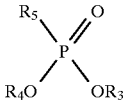

(II)

9 Claims, No Drawings

LUBRICATING COMPOSITIONS

BACKGROUND OF THE INVENTION

1. Field of the Invention

This application is a Rule 371 of PCT/GB96/01173 filed May 16, 1996.

This invention relates to compositions suitable for use as lubricants, more particularly for use as slideway lubricants.

2. Description of Related Art

Machine tools are frequently required to manufacture articles to very fine tolerances, for example the tolerance in the manufacture of a cam shaft may be only about one micron. For this purpose the machine tool must be accurately positioned. Slideway lubricants are the lubricants that are used to lubricate the surface on which the machine tool is mounted to facilitate the accurate positioning required.

Esters of phosphoric acid have been previously proposed for use as friction reducing agents in slideway lubricating compositions, for example the mono and di amyl esters of phosphoric acid have been described in combination with fatty materials such as sulphurised esters.

Previously, it has been necessary for these fatty materials to be present in significant amounts, typically 1% to 5% by weight and the esters of phosphoric acid to be present in amount from 0.05 to 1% by weight of the lubricating composition. It is desirable to be able to reduce the amounts of additives, not only for economic reasons, but because they can contaminate the metal working fluid.

SUMMARY OF THE INVENTION

The present invention provides a solution to this problem by providing a composition containing a phosphonate ester and an acid ester phosphate which enables the required low friction properties to be achieved at lower levels of additive than previously. According to the present invention there is provided a lubricating composition comprising:

(a) a base oil, (b) from about 0.05, preferably from about 0.1, to 0.6% by total weight of (a), (b) and (c) of an acid ester of phosphoric acid of formula:

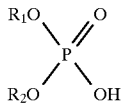

where $R_1$ is a monovalent organic group containing from 3 to 30 carbon atoms and $R_2$ is hydrogen or a monovalent organic group containing from 3 to 30 carbon atoms and (c) from 0.1, preferably from 0.25, to 0.7% by total weight of (a), (b) and (c) of a phosphonate ester of formula:

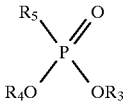

where $R_3$ and $R_4$ are independently monovalent organic groups containing from 1 to 10 carbon atoms and $R_5$ is a monovalent organic group containing from 4 to 30, preferably 10 to 24 carbon atoms.

The base oil can be any lubricating oil whether natural or synthetic. The natural oils include paraffinic, naphthenic and aromatic oils or mixtures thereof. Among the synthetic oils are polyalphaolefin fluids, polyoxyalkylenes, polyacetals, polysiloxanes and esters.

The esters are those made from polyhydric alcohols and monocarboxylic acids such as from pentaerythritol or neopentyl glycol and its homologs and aliphatic monocarboxylic acids having from 4 to 9 carbon atoms. Also useful are those esters made from dicarboxylic acids eg sebacic acid and monohydric alcohols eg 2-ethylhexanol. In the acid esters of the above formula $R_1$ and $R_2$ (when not hydrogen) are preferably an aliphatic group, for example, an alkyl or alkenyl group which is preferably straight chain and preferably contains from 5 to 20 carbon atoms. $R_1$ is conveniently the same as $R_2$.

Both the mono and diesters are suitable and mixtures of the two may be used. A particularly convenient ester is a mixture of the two forms in approximately equimolar proportions eg from 40:60 to 60:40 for example a mixture of the di and mono n-heptyl acid phosphates. In the phosphonates of the above formula preferably $R_3$ and $R_4$ are each an aliphatic group, for example containing from 1 to 10 carbon atoms, more preferably 1 to 6 carbon atoms. $R_5$ preferably contains more carbon atoms than $R_3$ or $R_4$ and is also preferably an aliphatic group and conveniently contains from 12 to 24 carbon atoms, more preferably 15 to 20 carbon atoms.

Preferably $R_5$ contains no aromatic substitution and is most preferably an alkyl group which is desirably straight chain. Some braching can be accepted but preferably the phosphonate contains not more than 1% by weight of branched material.

The molar proportions of acid ester to phosphonate can be from 1:5 to 2:1, preferably from 1:2 to 1.5:1. The compositions of the present invention are suitable for use as slideway lubricants. When this is their intended use they can contain other additives that are conventionally added to slideway lubricants in the amounts in which these are normally present. For example, antioxidants such as phenol type antioxidants eg in amount about 0.1%. antiwear agents such as alkyl or aryl phosphites eg dibutyl hydrogen phosphite eg in amount up to about 0.5%, demulsifiers such as ethylene oxide/propylene oxide copolymers eg in amount about 0.002%, metal passivators eg in amount about 0.05% and antifoam agents eg in amount about 0.005%, all percentages being by weight based on the total composition.

DETAILED DESCRIPTION OF THE PREFERRED EMBODIMENT

It is preferred that the lubricating compositions according to the invention have a static coefficient of friction of less than 0.110, more preferably less than 0.105, most preferably less than 0.100. as measured by the method described below.

The acid ester of phosphoric acid and the phosphonate ester may be mixed together to form an additive concentrate or "package" before addition to the base oil. According to another aspect of the present invention there is provided an additive concentrate for blending with a base oil to prepare a lubricating composition, said additive concentrate comprising an acid ester of phosphoric acid as hereinbefore defined and a phosphonate ester as hereinbefore defined the molar proportion of acid ester to phosphonate being 1:5 to 2:1.

The additive concentrate may contain any or all of the other additives mentioned above such as antioxidants, antiwear agents, demulsifiers, metal passivators and antifoam agents in amounts so that when the concentrate is diluted with the base oil the resulting lubricating composition contains the required amount of additives.

The invention is illustrated by the following Example.

EXAMPLE 1

Lubricating compositions were prepared by blending a base oil with (a) different acid phosphates (b) different phosphonates and (c) with both acid phosphate and phosphonate. The compositions were prepared by adding the phosphate ester and/or the phosphonate ester to the base oil which had been warmed to 40° to 50° C. and stirring the mixture.

The coefficient of friction was measured for each composition.

The amounts of the components and the coefficients of friction are recorded in the table below. The coefficients of friction measured were the static coefficients of friction under boundary lubrication conditions and were obtained using a Cameron Plint TE 77 high frequency friction machine. The machine consists of an oil bath into which is fastened a cast iron plate. The bath is filled with oil (either formulated or non-formulated). A moving slide, made from cast iron or epoxy resin, of known surface area is placed on top of the fixed plate under a known force. The top slide is moved with a reciprocating motion over the fixed plate. The fixed plate is attached to a piezo electric crystal capable of detecting small movements. These movements are converted into voltage and are displayed on an oscilloscope as a pseudo square wave, the emplitude of which is indicative of the static coefficient of friction. The method employed is described by A G Plint and M A Plint in Tribology International August 1985 Volume 18 No 4 pages 247 to 249 published by Butterworth and Co (Publishers) Ltd. The procedure described in this reference was followed exactly except (i) that no elastic layer was employed between the driving head and moving specimen, (ii) the moving specimen had a surface area of 30 by 20 mm rather than 10 by 10 mm (iii) the temperature was 20° C. rather than 50° C. and (iv) the load was 60N rather than 250N.

TABLE

| Run No | Composition | Friction Coefficient |
|---|---|---|
| 1. | base oil | 0.298 |
| 2. | base oil + 0.5% DMODP | 0.196 |
| 3. | base oil + 0.5% DMODP + 0.3% HAP | 0.093 |
| 4. | base oil + 0.25% AAP | 0.108 |
| 5. | base oil + 0.5% DMODP + 0.25% AAP | 0.104 |
| 6. | base oil + 0.3% HAP | 0.112 |
| 7. | base oil + 0.35% NAP | 0.203 |
| 8. | base oil + 0.5% DMODP + 0.35% NAP | 0.135 |
| 9. | base oil + 0.45% TDAP | 0.223 |
| 10. | base oil + 0.45% TDAP + 0.5% DMODP | 0.165 |
| 11. | base oil + 0.58% OAP | 0.188 |
| 12. | base oil + 0.5% DMODP + 0.58% OAP | 0.122 |
| 13. | base oil + 0.35% DBBP | 0.281 |
| 14. | base oil + 0.35% DBBP + 0.25% AAP | 0.113 |
| 15. | base oil + 0.35% DBBP + 0.3% HAP | 0.121 |
| 16. | base oil + 0.35% DBBP + 0.35% NAP | 0.188 |
| 17. | base oil + 0.35% DBBP + 0.45% TDAP | 0.197 |
| 18. | base oil + 0.35% DBBP + 0.58% OAP | 0.177 |

The base oil was a 150 solvent neutral lubricating oil base stock.

The percentages are by weight based on the total weight of base oil and phosphate and/or phosphonate. The amounts of DMODP and HAP were selected and then the amounts of the other additives were calculated so that the composition of each run had the same number of moles of phosphate and phosphonate.

The acid phosphates used were all 1:1 mixtures of the mono and di esters. In each the alkyl groups were straight chain. The abbreviations used in the above Table are as follows:

DMODP is dimethyl n-octadecyl phosphonate
DBBP is di n-butyl n-butyl phosphonate
AAP is n-amyl acid phosphate
HAP is n-heptyl acid phosphate
NAP is n-nonyl acid phosphate
TDAP is n-tridecyl acid phosphate
OAP is n-oleyl acid phosphate.

Runs 1,2,4,6,7,9,11 and 13 are not according to the invention and are included for comparative purposes. Comparison of Runs 2,3 and 6 shows that the combination of DMODP with HAP is superior to either HAP or DMODP alone. Runs 2, 4 and 5 show that the combination of DMODP with AAP is superior to either AAP or DMODP alone, Runs 2, 7 and 8 show that the combination of DMODP with NAP is superior to either NAP or DMODP alone. Runs 2,9 and 10 show that the combination of DMODP with TDAP is superior to either DMODP or TDAP alone. Runs 2, 11 and 12 show that the combination of DMODP with OAP is superior to either OAP or DMODP alone.

Comparison of Runs 1 and 13 shows that the use of DBBP (which is a non preferred phosphonate) alone gives a small improvement over the base oil. Runs 4 and 14 shows that the combination of DBBP with AAP is not as effective as AAP alone.

Further, comparison of Run 6 with 15 shows that the combination of DBBP with HAP is not as effective as HAP alone.

Comparison of Run 7 with 16 shows that DBBP with NAP is more effective than NAP alone. Runs 17 and 18 also show that DBBP gives an improvement when combined with TDAP or OAP over these phosphates used alone.

We claim:

1. A lubricating composition comprising:

(a) a base oil, (b) from about 0.05 to 0.6% by total weight of (a), (b) and (c) of an acid ester of phosphoric acid of formula:

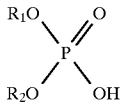

where $R_1$ is a monovalent organic group containing from 3 to 30 carbon atoms and $R_2$ is hydrogen or a monovalent organic group containing from 3 to 30 carbon atoms and (c) from 0.1 to 0.7% by total weight of (a), (b) and (c) of a phosphonate ester of formula:

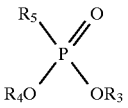

where $R_3$ and $R_4$ are independently monovalent organic groups containing from 1 to 10 carbon atoms and $R_5$ is a monovalent organic group containing from 4 to 30.

2. The lubricating composition as claimed in claim 1 wherein the groups $R_1$ and $R_2$ are aliphatic groups containing from 4 to 24 carbon atoms.

3. The lubricating composition as claimed in claim 1 wherein the groups $R_3$ and $R_4$ are alkyl or alkenyl groups containing from 1 to 6 carbon atoms.

4. The lubricating composition as claimed in claim 1 wherein the group $R_5$ contains from 12 to 24 carbon atoms.

5. The lubricating composition as claimed in claim 1 wherein the molar ratio of acid ester to phosphonate is from 1:5 to 2:1.

6. The lubricating composition of claim 1 wherein said acid ester of phosphoric acid is present in an amount of from about 0.1 to 0.6% by total weight of (a), (b) and (c).

7. The lubricating composition of claim 1 wherein said phosphonate ester is present in an amount of from 0.25 to 0.7% by total weight of (a), (b) and (c).

8. The lubricating composition of claim 1 wherein $R_5$ is a monovalent organic group containing from 10 to 24 carbon atoms.

9. The lubricating composition of claim 1 comprising:

(a) a base oil, (b) from about 0.1 to 0.6% by total weight of (a), (b) and (c) of an acid ester of phosphoric acid of formula:

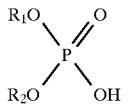

where $R_1$ is a monovalent organic group containing from 3 to 30 carbon atoms and $R_2$ is hydrogen or a monovalent organic group containing from 3 to 30 carbon atoms and (c) from 0.25 to 0.7% by total weight of (a), (b) and (c) of a phosphonate ester of formula:

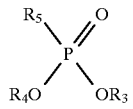

where $R_3$ and $R_4$ are indepedently monovalent organic groups containing from 1 to 10 carbon atoms and $R_5$ is a monovalent organic group containing from 10 to 24 carbon atoms.

* * * * *